US007264115B1

(12) United States Patent
Uittenbogaard et al.

(10) Patent No.: US 7,264,115 B1
(45) Date of Patent: Sep. 4, 2007

(54) HANGING DISPLAY PACKAGE FOR INTIMATE APPAREL

(75) Inventors: Jolanda Uittenbogaard, Winston-Salem, NC (US); Hilton Graham, Winston-Salem, NC (US); Chandra Arrington, Winston-Salem, NC (US)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 611 days.

(21) Appl. No.: 10/741,401

(22) Filed: Dec. 19, 2003

(51) Int. Cl.
*B65D 85/18* (2006.01)

(52) U.S. Cl. ..... 206/293; 206/297; 206/289; 206/285; 206/278

(58) Field of Classification Search ..... 206/278, 206/279, 281, 282, 283, 284, 285, 286, 292, 206/294, 296, 297, 299; 223/85, 87
See application file for complete search history.

(56) References Cited

U.S. PATENT DOCUMENTS

| | | | | | |
|---|---|---|---|---|---|
| 1,838,597 | A | | 12/1931 | Vineberg | |
| 2,273,302 | A | * | 2/1942 | Vineberg | 206/280 |
| 2,320,018 | A | * | 5/1943 | Ullman | 229/120.18 |
| 2,508,579 | A | * | 5/1950 | McFall | 206/284 |
| 2,941,703 | A | | 6/1960 | Abramowitz | |
| 3,057,462 | A | * | 10/1962 | Rouder | 206/294 |
| 3,462,006 | A | * | 8/1969 | Scott | 206/756 |
| 3,664,572 | A | * | 5/1972 | Puckkoff et al. | 229/103.2 |
| 3,687,277 | A | * | 8/1972 | Spencer et al. | 206/284 |
| 4,148,421 | A | * | 4/1979 | Levitt | 223/87 |
| 4,190,151 | A | | 2/1980 | Russell | |
| 4,718,546 | A | * | 1/1988 | Kolton et al. | 206/296 |
| 4,744,496 | A | * | 5/1988 | Blanchard et al. | 223/95 |
| D342,387 | S | * | 12/1993 | Bro et al. | D6/315 |
| 5,469,959 | A | | 11/1995 | Gummer | |
| 5,503,269 | A | | 4/1996 | DeBiasio | |
| 5,515,966 | A | | 5/1996 | Hodge et al. | |
| D376,263 | S | * | 12/1996 | Gouldson | D6/315 |
| 5,598,922 | A | | 2/1997 | Good | |
| 6,032,793 | A | | 3/2000 | Oakley | |
| 6,237,762 | B1 | | 5/2001 | Faircloth | |
| 6,349,863 | B1 | | 2/2002 | Frye | |
| 6,508,357 | B1 | * | 1/2003 | Faircloth et al. | 206/284 |
| 6,612,431 | B2 | * | 9/2003 | Faircloth | 206/299 |
| 6,715,650 | B2 | * | 4/2004 | Gouldson | 223/93 |

* cited by examiner

*Primary Examiner*—Tri M. Mai
(74) *Attorney, Agent, or Firm*—Womble Carlyle Sandridge & Rice, PLLC

(57) ABSTRACT

A hanging display package for an article of apparel. The display package comprises a rear panel having opposed side edges that define a first width. A pair of flaps project laterally outwardly from each of the opposed side edges. A front panel has opposed side edges defining a second width that is narrower than the width of the rear panel. The bottom edge of the front panel is substantially centered along and hingedly connected to the rear panel. An aperture is formed through the front panel for receiving a garment hanger. When a garment is placed on the garment hanger, the laterally projecting flaps are folded inwardly to fold the garment inward, and the rear panel is folded upwardly to fold the garment upward, a compact hanging display package is formed.

24 Claims, 8 Drawing Sheets

HANGING DISPLAY PACKAGE FOR INTIMATE APPAREL

FIELD OF THE INVENTION

The present invention relates to the fields of packaging and retail displays, and, more particularly, to a space-saving, aesthetically pleasing hanging display package for plus-size intimate apparel.

BACKGROUND OF THE INVENTION

Manufacturers of intimate apparel are seeking to increase sales by developing products for both petite and plus-size customers. In addition, intimate apparel manufacturers have expanded their offerings to plus-size customers to include "fashion" intimate apparel. By "fashion" intimate apparel, we mean intimate apparel that is made from fabric that is not just a single color, such as black or white, but is made from fabric bearing an aesthetically pleasing design, a leopard print, for example. Fashion intimate apparel, however, needs to be displayed in a package that allows a customer to easily see the fabric design and even touch the fabric.

Conventionally, plus-size intimate apparel was sold by boutique or specialty retailers that specialized in selling plus-size apparel. This allowed consumers of plus-size intimate apparel to select and purchase products in relative privacy. A disadvantage, however, of distributing products through such specialty retailers is that their distribution is relatively limited, particularly, in comparison to large retail chain and mass merchants, such as, Walmart. Thus, not surprisingly, manufacturers of plus-size intimate apparel have begun selling their products through such mass merchants.

Distributing plus-size intimate apparel through mass merchants, however, creates other problems. First, mass merchants, of course, are very cost conscious, and seek to maximize display space. Conventionally packaged plus-size intimate apparel, however, generally requires more display space simply because the products themselves are relatively larger. In addition, as shown by FIG. 1, display racks of conventionally packaged plus-size intimate apparel are not particularly aesthetically pleasing, which may negatively affect the sales of such products. Also, the large retail stores operated by mass merchants lack the relative privacy of boutique and specialty retailers. Thus, a consumer may feel self-conscious, uncomfortable and/or embarrassed in selecting and purchasing plus-size intimate apparel products, which also could negatively affect sales.

Thus, what is needed is a hanging display package for fashion plus-size intimate apparel that overcomes the disadvantages of conventionally packaged plus-size intimate apparel, particularly, in the mass merchant retail environment.

SUMMARY OF THE INVENTION

One aspect of the present invention is a blank for forming into a hanging display package for an article of apparel of the type that conventionally has been supported and displayed on a hanger.

In one embodiment, the blank includes a rear panel having an inner surface and an outer surface. The rear panel also has a top edge, a bottom edge, and first and second opposed side edges, the opposed side edges of the rear panel defining a first width therebetween. A pair of flaps project laterally outwardly from, and are hingedly connected to, the opposed side edges. The blank also includes a front panel having an inner surface and an outer surface, a top edge, a bottom edge, and first and second opposed side edges. The opposed side edge of the front panel defines a second width therebetween. The bottom edge of the front panel is substantially centered along and hingedly connected to the top edge of the rear panel along a fold line. An aperture is formed through the front panel proximate to the top edge of the front panel for receiving a garment hanger hook. When a garment is placed on a garment hanger, the laterally projecting flaps are folded inwardly to fold the garment inwardly against the inner surface of the rear panel, and the rear panel is folded upwardly along the fold line to fold the garment upwardly, thereby forming a compact hanging display package. The second width of the front panel is narrower than the first width of the rear panel. Conversely, the second width of the front panel is wider than the first width of the rear panel.

The blank may include a first fastener for releasably attaching the rear panel to the front panel. The first fastener has a tab portion extending upwardly from the top edge of the front panel and an aperture proximate to the bottom edge of the rear panel for interlocking with the tab portion. The blank may include a second fastener for releasably attaching the first laterally outwardly projecting flap to the second laterally outwardly projecting flap when the first and second flaps are folded inwardly. The second fastener has a first interlocking tab formed on the outer edge of the first laterally outwardly projecting flap and a second mating interlocking tab formed on the outer edge of the second laterally outwardly projecting flap.

A second aspect of the present invention is directed to a hanging display package for an article of apparel, such as, an undergarment with an elastic waistband. In addition to the blank described above, the hanging display package also includes a horizontal garment support and a hook that is connected to and projects upwardly from the horizontal garment support. The hook is dimensioned so that it can be inserted through the aperture in the front panel of the blank. The garment hanger may also include a tab attached to the hook for the display of indicia thereon. The garment hanger may also include a plurality of projections. Each of the projections is connected to and extends downwardly from the horizontal garment support. A first outer projection is proximate to a first end of the horizontal garment support and a second outer projection is proximate to a second end of the horizontal garment. In addition, a first inner projection is proximate to the first outer projection and a second inner projection is proximate to the second outer projection. A first folded portion of a folded garment may be wrapped around the first outer projection and the first end portion of a folded garment may be releasably secured to the first inner projection. Similarly, a second folded portion of a folded garment maybe wrapped around the second outer projection and the second end portion of the folded garment maybe releasably secured to the second inner projection. The garment hanger may be formed of molded plastic or other suitable materials.

A third aspect of the present invention is directed to a packaged article of apparel. In addition to the blank and garment support described above, the packaged article of apparel includes an article of apparel, such as underwear. The underwear may have an elastic waistband, and the width of the garment support is less than one-half the circumference of the elastic waistband.

DETAILED DESCRIPTION OF THE PREFERRED EMBODIMENTS

Figure 1:
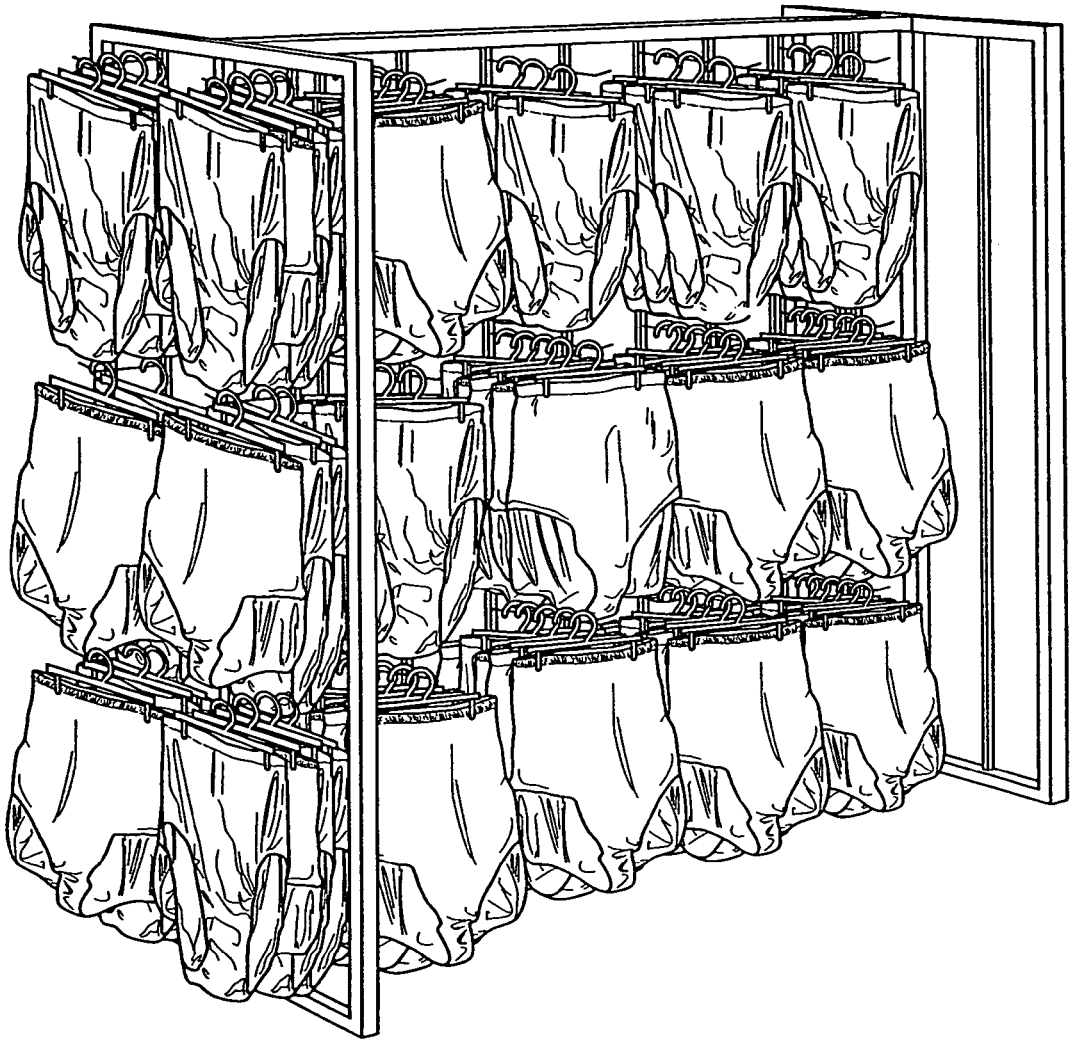
FIG. 1 PRIOR ART
FIG. 1 is a prior art display rack illustrating conventional hanging packaged garments.
Figure 2:
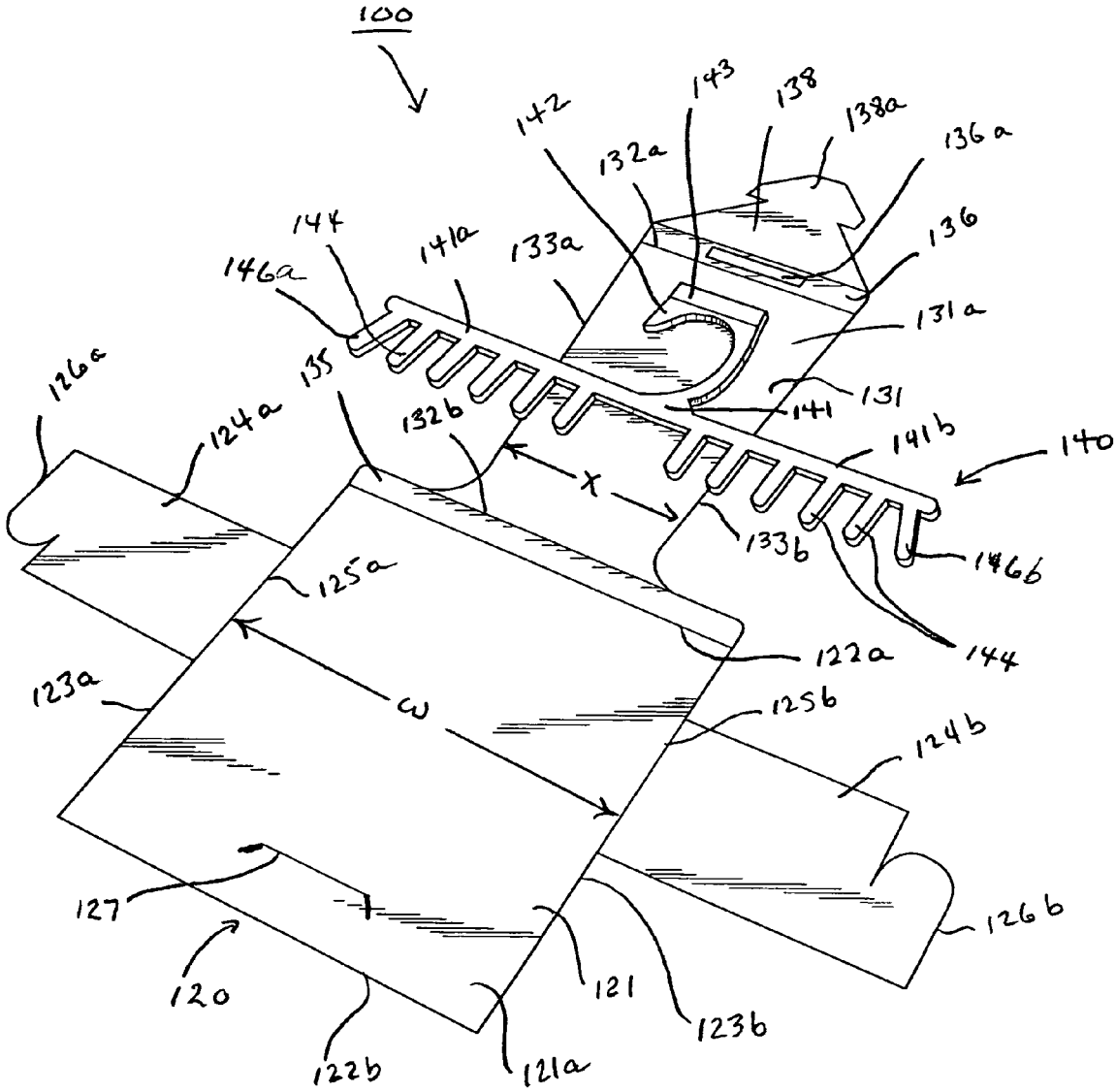
FIG. 2 is a perspective exploded view of the package blank and hanger of the present invention.

Referring now to the figures in general, and to FIG. 2 in particular, it will be understood that the illustrations are for the purpose of describing a preferred embodiment of the invention and are not intended to limit the invention thereto. As best seen in FIG. 2, an exploded view of the hanging display package is shown generally as 100. The hanging display package 100 includes a blank 120 for forming/folding into a package, and a garment hanger 140.

The blank 120 may be formed from a unitary foldable sheet material such as paperboard, where the weight of the paperboard is dependent on the weight of the articles of apparel being packaged. One source of such blank sheet material is Cadmus Specialty Packaging in Charlotte, N.C. The blank 120 comprises a generally rectangular rear panel 121 having inner and outer surfaces 121*a* and 121*b*. Desirably, both surfaces 121*a*, 121*b* are coated with a water-soluble silicon based material or other coating material that is suitable for printing thereon. The rectangular rear panel 121 is bounded by a top edge 122*a*, a bottom edge 122*b*, and opposed side edges 123*a*, 123*b*. As shown in FIG. 2, the opposed side edges 123*a*, 123*b* define the rear panel width, shown as dimension 'w'. Laterally projecting flaps 124*a*, 124*b* are hingedly connected to the rear panel 121 along fold lines 125*a*, 125*b*. While not required for the satisfactory use of the present invention, interlocking tabs 126*a*, 126*b* are formed at the outer ends of the laterally projecting flaps 124*a*, 124*b* to interlock the flaps when they are subsequently folded inwardly. As can be appreciated, other means can be used to attach flaps 124*a*, 124*b* to each other, such as fasteners, adhesives, etc. As will be better understood from the discussion that follows, a slit 127 is formed proximate to the bottom edge of the rear panel 121.

The blank 120 also includes a front panel 131 having inner and outer surfaces 131*a* and 131*b*. Again, the inner and outer surfaces 131*a*, 131*b* are preferably coated such that text, graphics, images, and other indicia may be printed on one or both of the surfaces. The generally rectangular front panel 131 includes a top edge 132*a*, a bottom edge 132*b*, and opposed side edges 133*a*, 133*b*. The opposed side edges 133*a*, 133*b* define a front panel width, shown as dimension 'x'. As will be understood from the description below, the width 'x' of the front panel is narrower than the width 'w' of the rear panel so that the displayed, packaged garment is visible and may be examined (touched) by a potential buyer.

To accommodate the thickness of a folded article of apparel, a lower, or bottom panel 135 hingedly adjoins the rear panel 121 and the front panel 131 along fold lines 122*a* and 132*b*. An upper, or top panel 136, is hingedly connected to the front panel 131 along a fold line that is coincident with the top edge 132*a* of the front panel 131. When the blank 120 is folded into a hanging display package 100, this top panel 136, in conjunction with the bottom panel 135, accommodate the folded thickness of an article of apparel. The top panel 136 also provides stability to the hanger 140. As also shown in FIG. 2, an aperture 136*a* is so dimensioned and formed through the top panel 136 for the insertion of a hanger hook therethrough.

The garment, or apparel, hanger 140 comprises a horizontal support 141 having laterally projecting arms 141*a*, 141*b*. A hook 142 is integrally formed with the support 141. The hanger 140 is desirably formed of a semi-rigid or rigid material such as molded plastic. A plurality of downwardly extending projections 144, including opposed outer projections 146*a*, 146*b* may be integrally molded with the garment hanger 140 for folding and securing the upper elastic waistband of an article of apparel, such as underwear. In particular, the opposed outer projections 146*a*, 146*b* at opposite ends of the arms 141*a*, 141*b* project downwardly and outwardly so that the folded portion of the waistband of an article of apparel, such as underwear, can be wrapped therearound and will not slip off of the hanger 140. Each of the opposed outer projections 146*a*, 146*b* have an outer edge, and the angle created by the axis of each of the outer edges of the opposed outer projections, 146*a*, 146*b* and the axis of the support 141 is less than ninety degrees (90°) to prevent the garment from slipping off the hanger 140.

Figure 3:
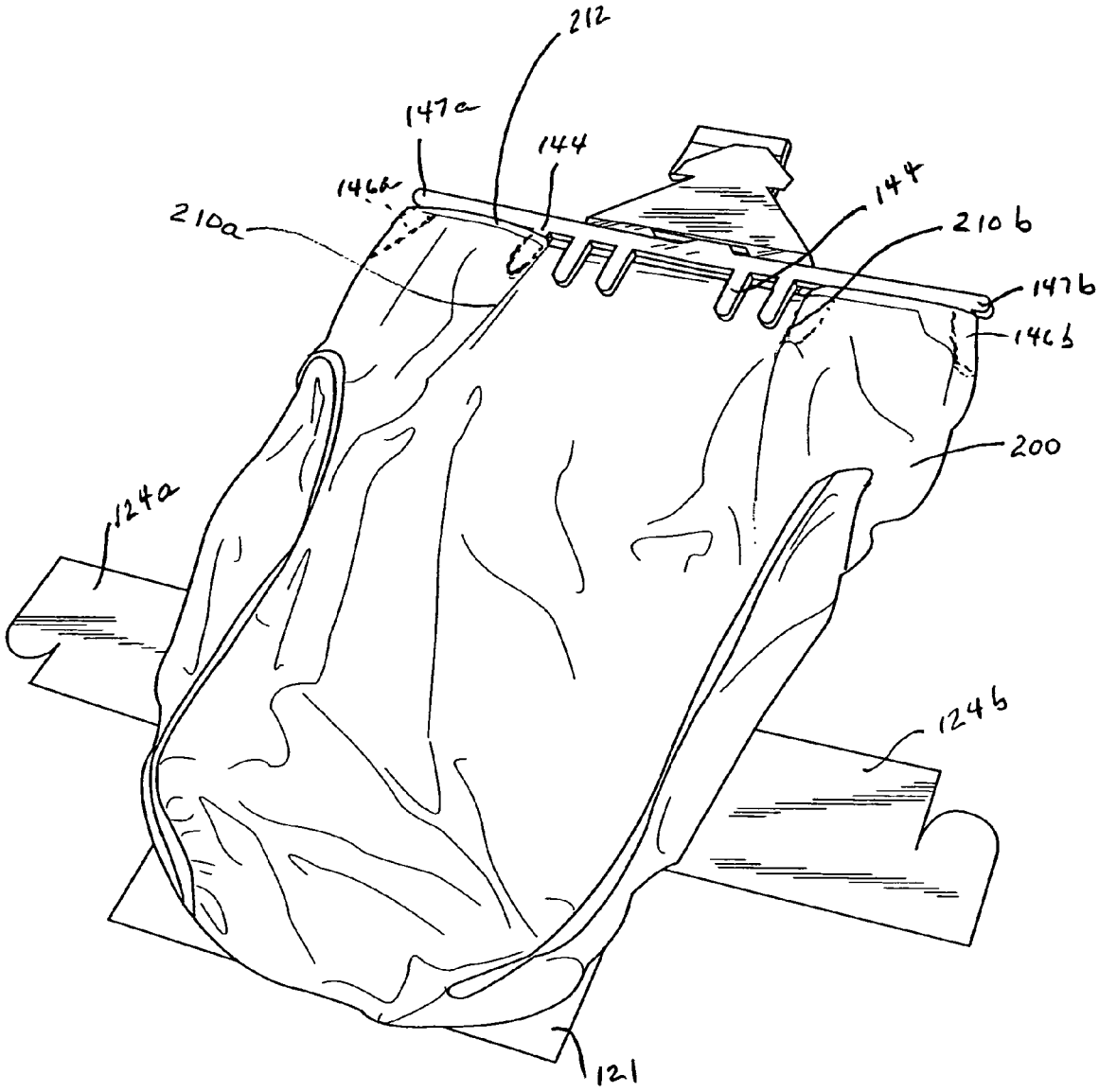
FIG. 3 is an environmental view of the hanging package of the present invention illustrating the initial step of packaging an article of apparel.

Turning now to FIGS. 3 through 7, the method of forming the hanging display package 100 from the blank 120 and hanger 140 is shown in step-by-step detail. Referring first to FIG. 3, an article of apparel, such as a pair of women's panties 200 with an elastic waistband, are placed over the open blank of FIG. 2. The folded portion of the waistband 212 of the panties 200 is wrapped around, from back to front, the opposed outer projections 146*a*, 146*b* of the hanger 140, causing the edges 210*a*, 210*b* of the panties 200 to fold inwardly. The waistband 212 is stretched slightly and the edge portions 210*a*, 210*b* on the panties 200 are releasably secured to one of the inner projections 144. The lips 147*a*, 147*b* of the hanger 140 prevent the waistband 212 from slipping upwardly over the top of the hanger 140, while the opposed outer projections 146*a*, 146*b* keep the waistband from sliding downwardly. The hook 142 of the hanger is inserted through the aperture 136*a* in the upper wall 136.

As can be appreciated, the width of the hanger 140 is preferably less than one-half the circumference of the waistband 212 of the panties 200, when the waistband is in a relaxed state. Thus, when the edges 210*a*, 210*b* are folded inwardly, the displayed overall width of the panties is advantageously reduced.

Figure 4:
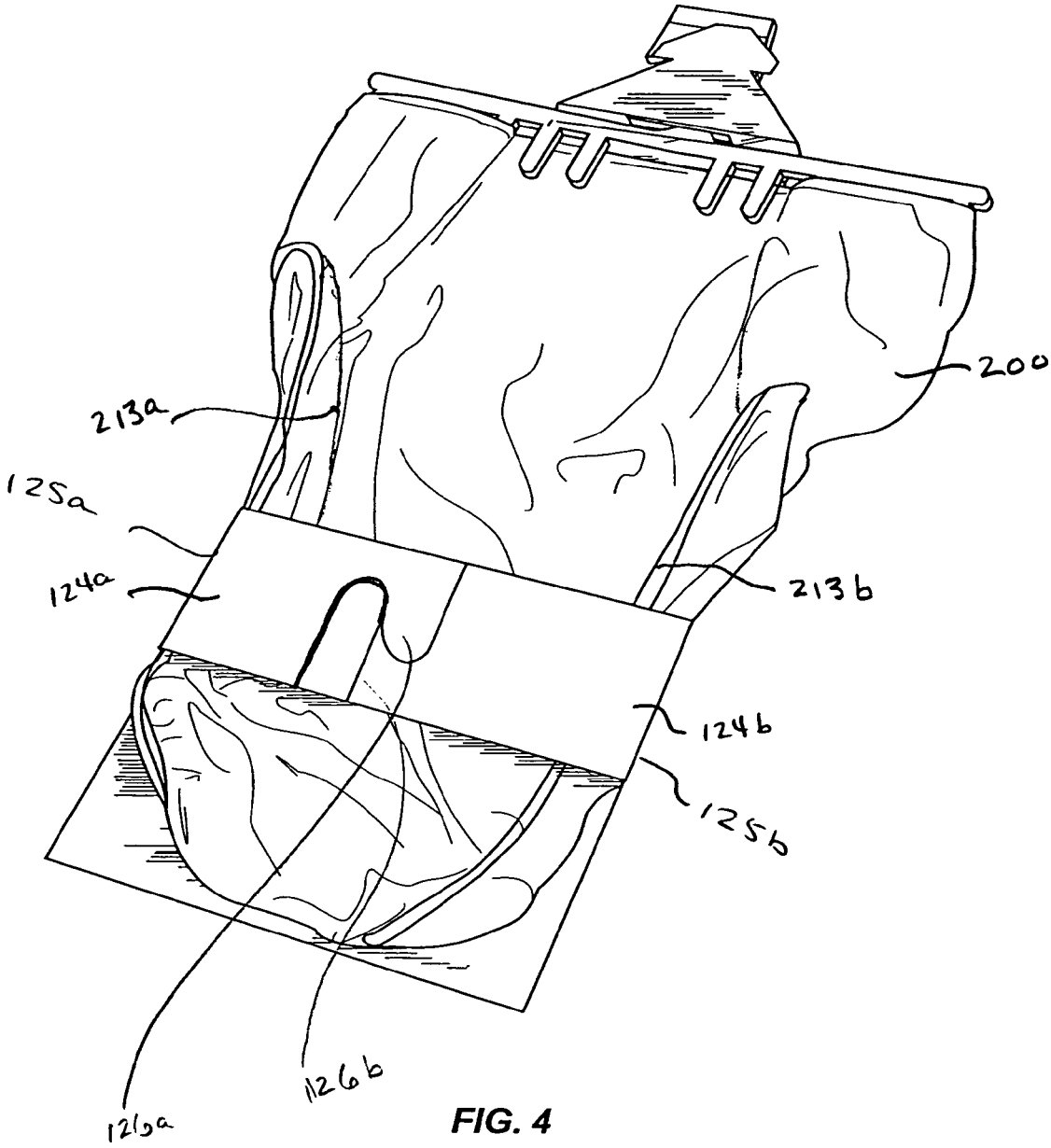
FIG. 4 is an environmental view of the hanging package of the present invention illustrating a second step in packaging an article of apparel.

Turning to FIG. 4, the laterally projecting flaps 124*a*, 124*b* are folded inwardly along fold lines 125*a*, 125*b*. The optional interlocking tabs 126*a*, 126*b* are then interlocked. As those skilled in the art will appreciate, and as mentioned above, there are a variety of ways to interlock the flaps or walls of a carton, and the present invention is not limited to the ones described herein. As seen in FIG. 4, when the flaps 124*a*, 124*b* are folded inwardly, the lower portion of the panties 200 are folded inwardly so that the width of the lower portion of the folded panties 200 is reduced to the width 'w' of the rear panel 121.

Figure 5:
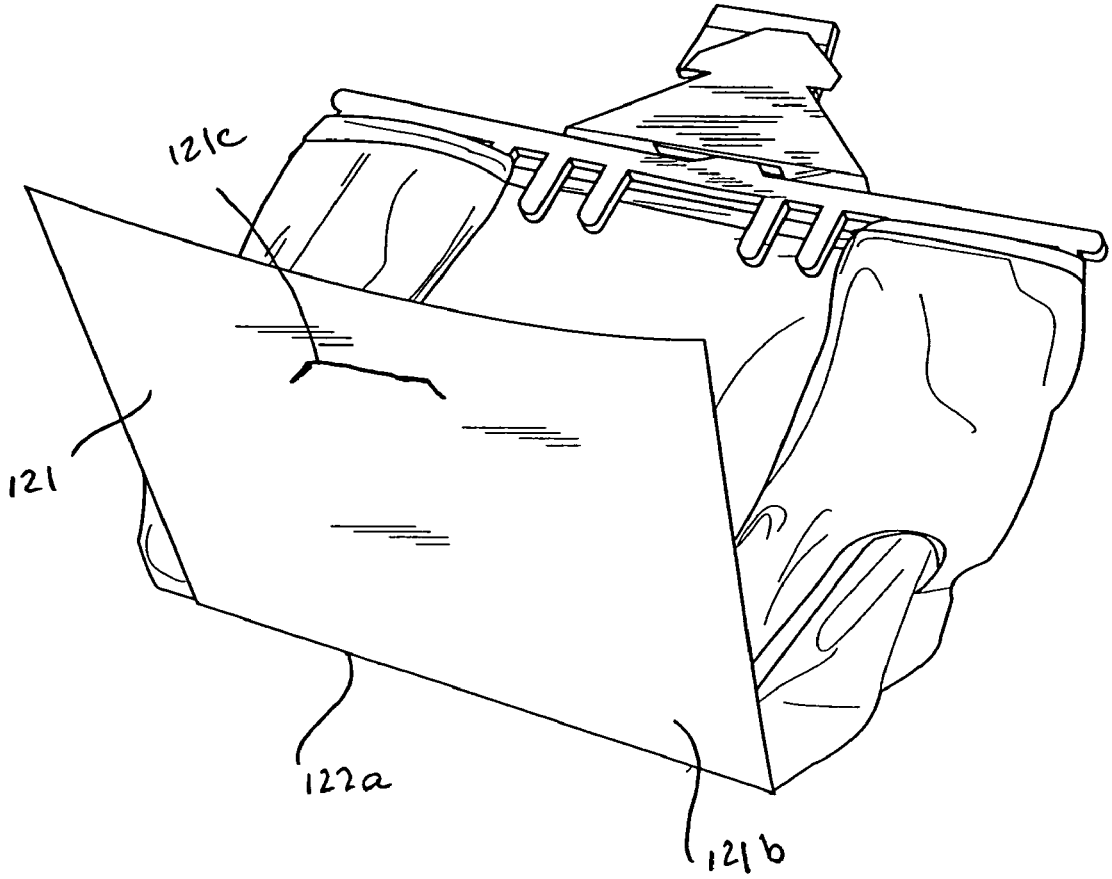
FIG. 5 is an environmental view of the hanging package of the present invention illustrating a third step in packaging an article of apparel.
Figure 6:
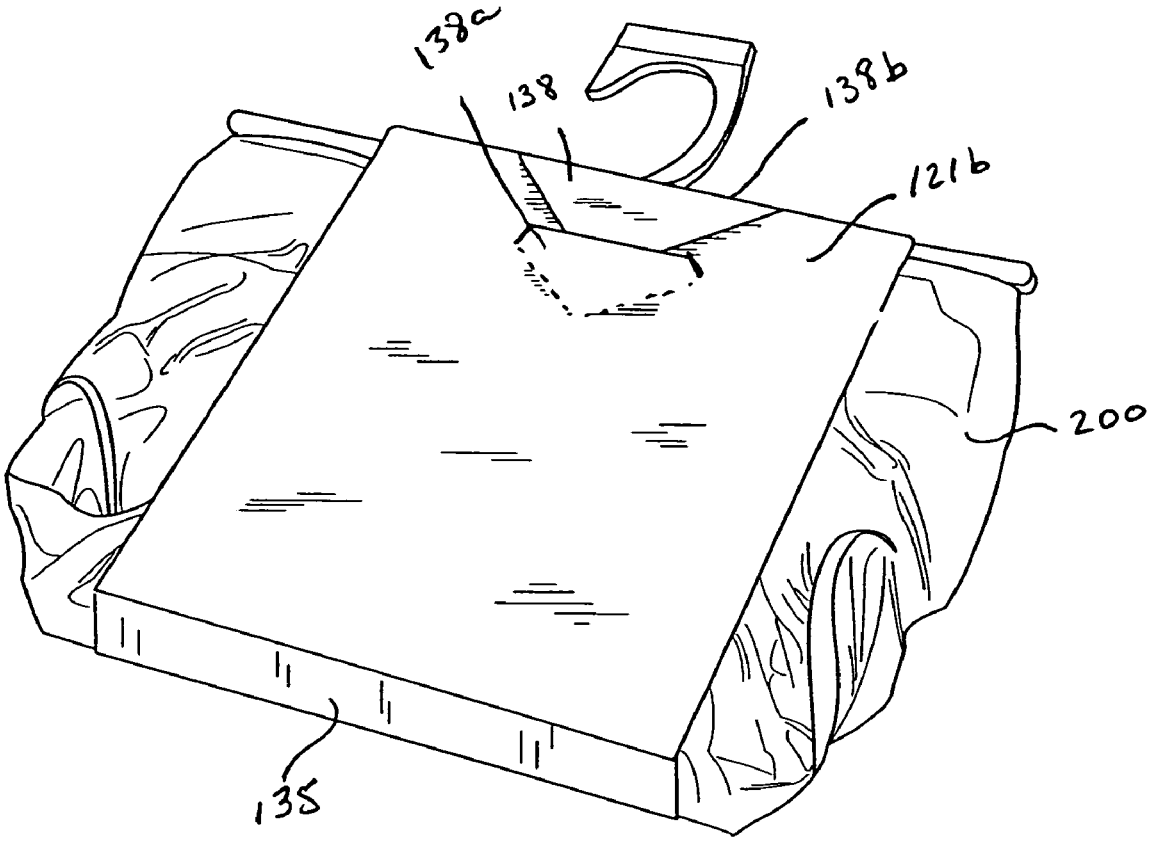
FIG. 6 is an environmental view of the hanging package of the present invention illustrating the final step in packaging an article of apparel.

Referring now to FIG. 5, the rear panel 121 is next folded upwardly along fold line 122*a*. At the same time, as shown in FIG. 6, the bottom panel 135 is folded outwardly along fold line 132*b*, and flap 138 is folded inwardly along fold line 138*b*. At the same time, the upper wall 136 is folded inwardly along fold line 132*a*. The interlocking tab 138*a* is then inserted in the slit 127 of the rear panel 121, completing the hanging display package assembly.

Figure 7:
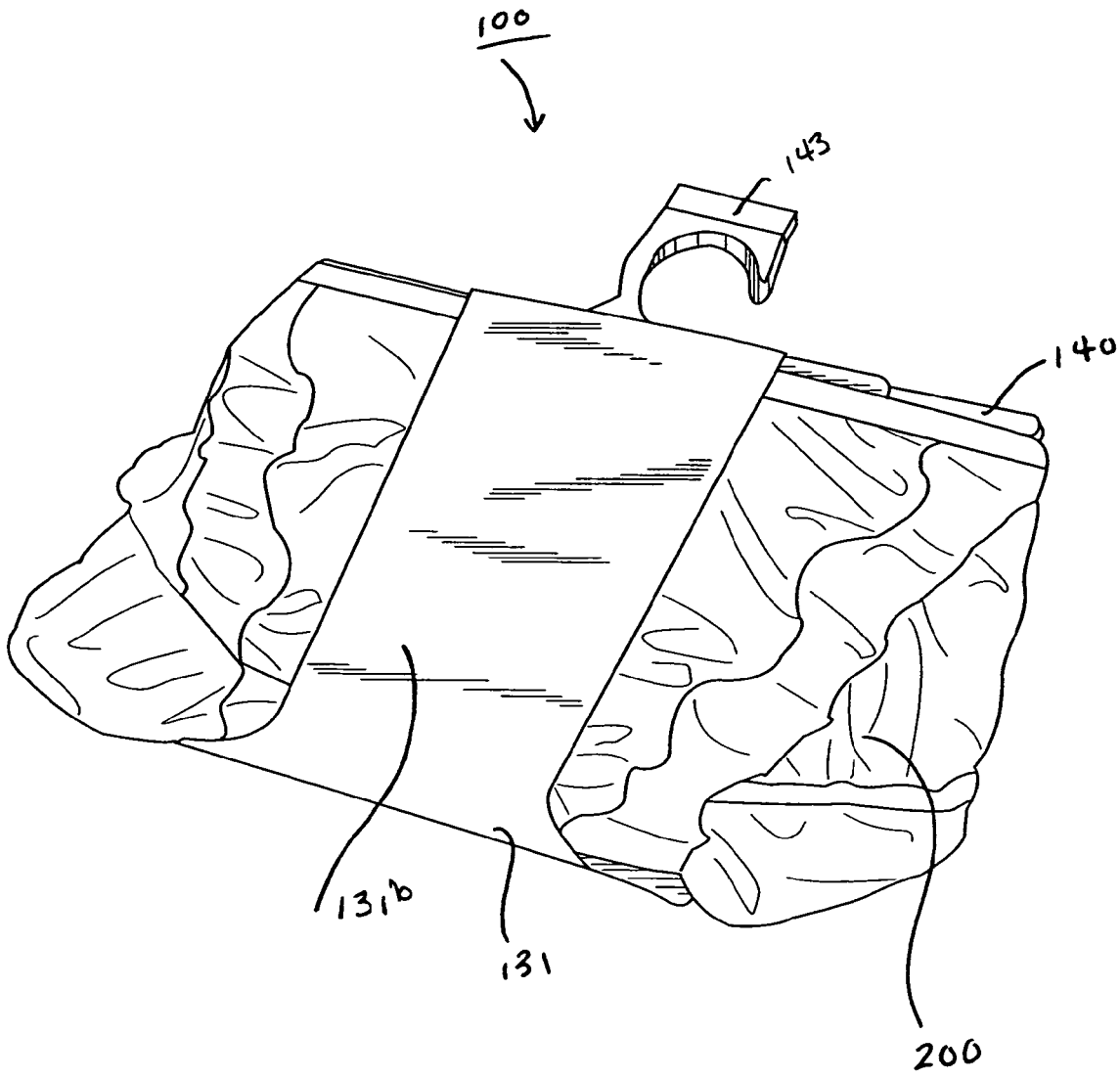
FIG. 7 is a front perspective view of the hanging package of the present invention.
Figure 8:
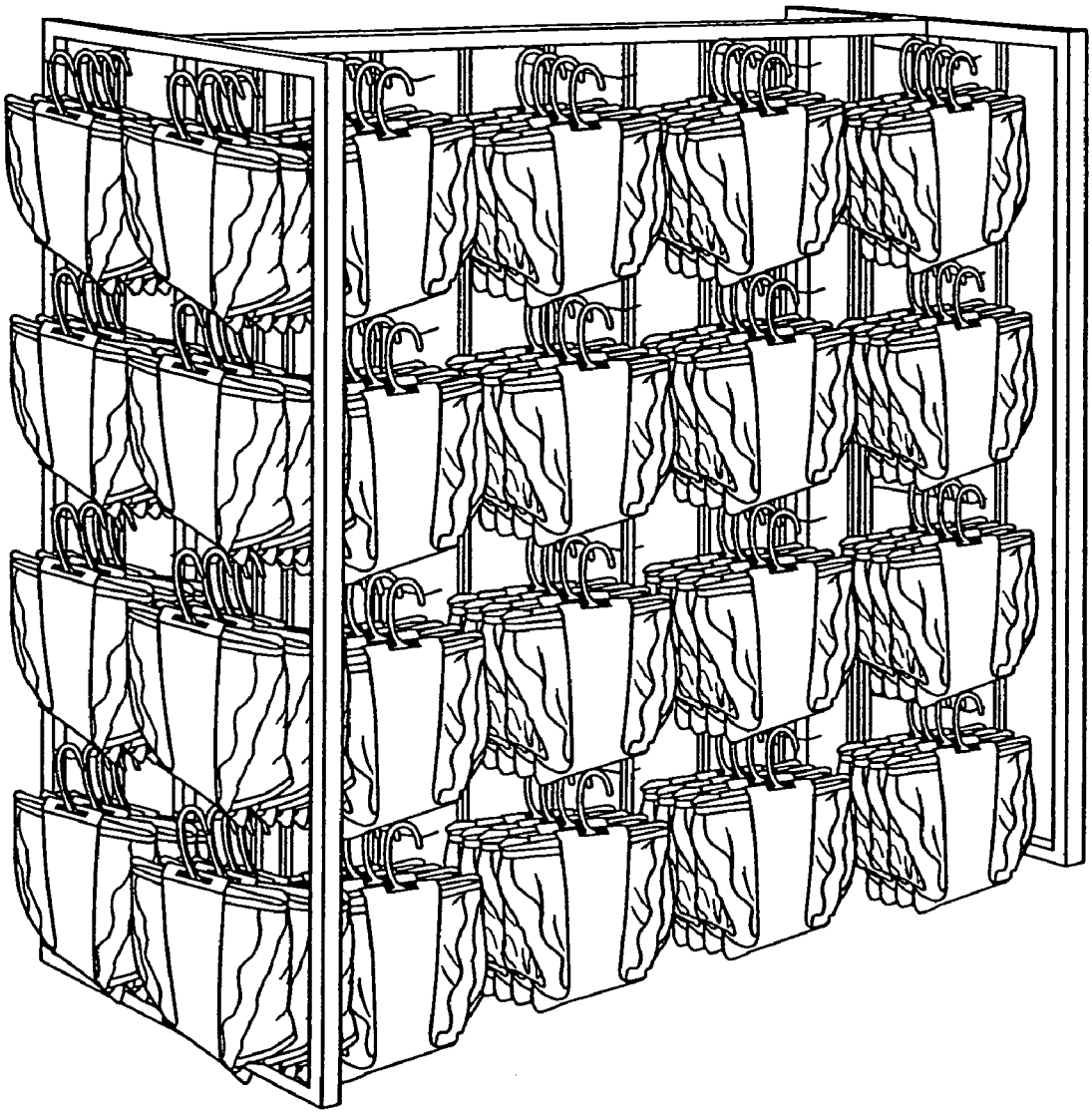
FIG. 8 is a perspective environmental view of a display rack illustrating the hanging package of the present invention.

Referring to FIGS. 7 and 8, the front of the hanging display package 100 is shown as it is displayed on a rack. While the panties have been folded inwardly and upwardly in a compact fashion, the material, color, and style of the panties 200 is visible to the potential buyer. This is due in part to the width 'x' of the front panel 131 being narrower than the width 'w' of the rear panel 121; however, sufficient surface area is still available for text, graphics, images, or other indicia to be printed or otherwise applied on the outer surface 131*b* of the front panel 131. Optionally, an upwardly protruding tab 143 providing size, pricing or other information may be affixed to the hook 142. As shown in the environmental view of FIG. 8, the resulting packaging and display system is compact, yet aesthetically pleasing to the potential buyer.

Although the present invention has been described with preferred embodiments, it is to be understood that modifications and variations may be utilized without departing from the spirit and scope of the invention, as those skilled in the art will readily understand. Such modifications and variations are considered to be within the purview and scope of the appended claims and their equivalents.

We claim:

1. A blank for forming into a hanging display package for an article of apparel, comprising:

(a) a first panel having:

(i) an inner surface and an outer surface;

(ii) a top edge, a bottom edge, and first and second opposed side edges, the opposed side edges defining a first width therebetween;

(iii) a first flap projecting laterally outwardly from and hingedly connected to the first opposed side edge, the first flap having an outer edge;

(iv) a second flap projecting laterally outwardly from and hingedly connected to the second opposed side edge, the second flap having an outer edge;

(b) a second panel having:

(i) an inner surface and an outer surface;

(ii) a top edge, a bottom edge, a length, and first and second opposed free side edges, the opposed free side edges defining a second width therebetween and each extending the substantial length of the second panel;

(iii) the bottom edge of the second panel being substantially centered along and hingedly connected to the top edge of the first panel along a fold line;

(iv) an aperture formed through the second panel proximate to the top edge of the second panel for receiving a garment hanger hook; and (c) wherein the first width of the first panel is wider than the second width of the second panel, wherein when the laterally projecting flaps are folded inwardly along the hinged connections with the opposed side edges of the first panel against the inner surface of the first panel, and the first panel is folded upwardly along the fold line upwardly against the inner surface of the second panel, a compact hanging display package is formed.

2. The blank of claim 1 further including a first fastener for releasably attaching the first plant to the second panel.

3. The blank of claim 2 wherein the first fastener comprises a tab portion extending upwardly from the top edge of the second panel and an aperture proximate to the bottom edge of the first panel for interlocking with the tab portion.

4. The blank of claim 1 further including a second fastener for releasably attaching the first laterally outwardly projecting flap to the second laterally outwardly projecting flap when the first and second flaps are folded inwardly.

5. The blank of claim 4 wherein the second fastener comprises a first interlocking tab formed on the outer edge of the first laterally outwardly projecting flap and a second mating interlocking tab formed on the outer edge of the second laterally outwardly projecting flap.

6. A hanging display package for an article of apparel, comprising:

(a) a first panel having:

(i) an inner surface and an outer surface;

(ii) a top edge, a bottom edge, and first and second opposed side edges, the opposed side edges defining a first width therebetween;

(iii) a first flap projecting laterally outwardly from and hingedly connected to the first opposed side wall, the first flap having an outer edge;

(iv) a second flap projecting laterally outwardly from and hingedly connected to the second opposed side edge, the second flap having and outer edge;

(b) a second panel having:

(i) an inner surface and an outer surface;

(ii) a top edge, a bottom edge, a length, and first and second opposed free side edges, the opposed free side edges defining a second width therebetween and each extending the substantial length of the second panel;

(iii) the bottom edge of the second panel being substantially centered along and hingedly connected to the top edge of the first panel along a fold line;

(iv) an aperture formed through the second panel proximate to the top edge of the second panel for receiving a garment hanger hook;

(c) a garment hanger having:

(i) a horizontal garment support;

(ii) a hook, the hook being connected to and projecting upwardly from the horizontal garment support, the hook dimensioned so that it can be inserted through the aperture in the second panel; and (d) wherein, the first width of the first panel is wider than the second width of the second panel, wherein when the laterally projecting flaps are folded inwardly along the hinged connections with the opposed side edges of the first panel against the inner surface of the first panel, and the first panel is folded upwardly along the fold line against the inner surface of the second panel, a compact hanging display package is formed.

7. The hanging display package of claim 6 further including a first fastener for releasably attaching the first panel to the second panel.

8. The hanging display package of claim 7 wherein the first fastener comprises a tab portion extending upwardly from the top edge of the second panel and an aperture proximate to the bottom edge of the first panel for interlocking with the tab portion.

9. The hanging display package of claim 8 wherein the garment hanger further includes a tab attached to the hook for the display of indicia thereon.

10. The hanging display package of claim 6 further including a second fastener for releasably attaching the first laterally outwardly projecting flap to the second laterally outwardly projecting flap, when the first and second flaps are folded inwardly.

11. The hanging display package of claim 10 wherein the second fastener comprises a first interlocking tab formed on the outer edge of the first laterally outwardly projecting flap and a second mating interlocking tab formed on the outer edge of the second laterally outwardly projecting flap.

12. The hanging display package of claim 6 wherein the garment hanger comprises a plurality of projections, wherein each of the plurality of projections is connected to and extends downwardly from the horizontal garment support, wherein a first outer projection is proximate to a first end of the horizontal garment support and a second outer projection is proximate to a second end of the horizontal garment, wherein a first inner projection is proximate to the first outer projection and a second inner projection is proximate to the second outer projection, wherein a first folded portion of a folded garment may be wrapped around the first outer projection and the first end portion of a folded garment may be releasably secured to the first inner projection, and a second folded portion of a folded garment maybe wrapped around the second outer projection and the second end portion of the folded garment may be realeasably secured to the second inner projection.

13. The hanging display package of claim 6 wherein the garment hanger is formed of molded plastic.

14. A packaged article of apparel, comprising:

(a) an article of apparel;

(b) a hanging display package for the article of apparel, comprising:

(i) a first panel having:

(1) an inner surface and an outer surface;

(2) a top edge, a bottom edge, and first and second opposed side edges, the opposed side edges defining a first width therebetween;

(3) a first flap projecting laterally outwardly from and hingedly connected to the first opposed side edge, the first flap having an outer edge;

(4) a second flap projecting laterally outwardly from and hingedly connected to the second opposed side edge, the second flap having an outer edge;

(ii) a second panel having:

(1) an inner surface and an outer surface;

(2) a top edge, a bottom edge, a length, and first and second opposed free side edges, the opposed free side edges defining a second width therebetween and each extending the substantial length of the second panel;

(3) the bottom edge of the second panel being substantially centered along and hingedly connected to the top edge of the first panel along a fold line;

(4) an aperture formed through the second panel proximate to the top edge of the second panel for receiving a garment hanger hook;

(c) an apparel hanger having:

(i) a horizontal support;

(ii) a hook, the hook connected to and projecting upwardly from the horizontal support, the hook dimensioned for insertion through the aperture in the second panel; and (d) wherein the first width of the first panel is wider than the second width of the second panel, and wherein when the article of apparel is placed on the apparel hanger, the laterally projecting flaps are folded inwardly along the hinged connections with the opposed side edges of the first panel to fold the article of apparel inwardly against the inner surface of the first panel, and the first panel is folded upwardly along the fold line to fold the apparel upwardly against the inner surface of the second panel, a compact hanging display package is formed.

15. The packaged article of apparel of claim 14 further including a first fastener for attaching the bottom edge of the first panel to the upper edge of the second panel.

16. The packaged article of apparel of claim 15 wherein the first fastener comprises a tab portion extending upwardly from the top edge of the second panel and an aperture proximate to the bottom edge of the first panel for interlocking with the tab portion.

17. The packaged article of apparel of claim 14 further including a second fastener for releasably attaching the first laterally outwardly projecting flap to the second laterally outwardly projecting flap, when the first and second flaps are folded inwardly.

18. The packaged article of apparel of claim 17 wherein the second fastener comprises a first interlocking tab formed on the outer edge of the first laterally outwardly projecting flap and a second mating interlocking tab formed on the outer edge of the second laterally outwardly projecting flap.

19. The hanging display package of claim 14 wherein the garment hanger comprises a plurality of projections, wherein each of the plurality of projections is connected to and extends downwardly from the horizontal garment support, wherein a first outer projection is proximate to a first end of the horizontal garment support and a second outer projection is proximate to a second end of the horizontal garment, where in a first inner projection is proximate to the first outer projection and a second inner projection is proximate to the second outer projection, wherein a first folded portion of a folded garment may be wrapped around the first outer projection and the first end-portion of a folded garment may be releasably secured to the first inner projection, and a second folded portion of a folded garment may be wrapped around the second outer projection and the second end portion of the folded garment may be realeasably secured to the second inner projection.

20. The packaged article of apparel of claim 14 wherein the garment hanger is formed of molded plastic.

21. The hanging display package of claim 20 wherein the garment hanger further includes a tab attached to the hook for the display of indicia thereon.

22. The hanging display package of claim 14 wherein the article of apparel is underwear.

23. The hanging display package of claim 22 wherein the underwear comprises an elastic waistband.

24. The hanging display package of claim 23 wherein the width of the horizontal support is less than one-half the circumference of the elastic waistband.

* * * * *

UNITED STATES PATENT AND TRADEMARK OFFICE

CERTIFICATE OF CORRECTION

PATENT NO. : 7,264,115 B1
APPLICATION NO. : 10/741401
DATED : September 4, 2007
INVENTOR(S) : Uittenbogaard et al.

It is certified that error appears in the above-identified patent and that said Letters Patent is hereby corrected as shown below:

In the Claims

In Claim 1, Column 6, Line 1, "upwardly" should be deleted.

Signed and Sealed this

Twenty-fifth Day of December, 2007

JON W. DUDAS
*Director of the United States Patent and Trademark Office*